US005379750A

United States Patent [19]

Larsen et al.

[11] Patent Number: 5,379,750

[45] Date of Patent: Jan. 10, 1995

[54] BURNER MOUNTING ASSEMBLY FOR GAS FURNACE

[75] Inventors: Michael J. Larsen, Danville; Robert C. Swilik, Jr., Indianapolis, both of Ind.

[73] Assignee: Carrier Corporation, Syracuse, N.Y.

[21] Appl. No.: 122,148

[22] Filed: Sep. 16, 1993

[51] Int. Cl.[6] ..... F24H 3/02

[52] U.S. Cl. ..... 126/110 R; 126/116 R; 431/286; 431/354

[58] Field of Search ..... 126/110 R, 116 R, 116 A, 126/99 R, 99 A, 391, 110 D, 110 B, 91 R; 431/286, 354, 355; 29/890.02

[56] References Cited

U.S. PATENT DOCUMENTS 3,314,610 4/1967 Reznor ..... 431/286
4,515,145 5/1985 Tallman et al. ..... 126/110 R
5,094,224 3/1992 Diesch ..... 126/110 R
5,186,620 2/1993 Hollingshead ..... 431/354
5,244,382 9/1993 Riehl ..... 431/354

*Primary Examiner*—James C. Yeung

[57] ABSTRACT

A burner assembly for a gas furnace includes an elongated support member and a number of individual burners. The support member includes consecutive yoke sections for receiving a corresponding burner and shelves for supporting a flange segment formed around the periphery of each burner. Each flange segment of the burners includes a pair of mounting apertures which receive bendable tabs provided on the support member when the burner is positioned within a corresponding yoke section and supported by consecutive shelves. When the tabs are bent over, the individual burners are secured to the support member. The support member also includes mounting ears for quickly mounting and removing the burner assembly to a bracket provided in the burner box of the gas furnace.

10 Claims, 4 Drawing Sheets

BURNER MOUNTING ASSEMBLY FOR GAS FURNACE

BACKGROUND OF THE INVENTION

1. Field of the Invention

This invention relates in general to gas furnaces and, in particular, to a burner mounting assembly for aligning combustion burners within a burner box so that a discharge end of each burner directs heated flue gas into a corresponding heat exchanger cell. More specifically, but without restriction to the particular embodiment hereinafter shown and described, this invention relates to a support member that releasably secures therein individual burners prior to assembly with the burner box.

2. Discussion of the Background Art

Gas furnaces typically include a primary heat exchanger positioned adjacent a burner box containing burners. During operation of the furnace, a blower moves circulating air over the heat exchanger to produce heated air that is directed to a desired location. Gas is supplied to the burner box by a gas manifold having orifices that direct the gas into the burners. The gas exiting the burners is ignited by an ignitor provided in the burner box. The burners allow combustion of the gas as well as direct heated flue gas into the heat exchanger. The typical heat exchanger includes cells with a channel or pass formed in each cell to direct the flow of flue gas produced by combustion. These cells are positioned side by side in a parallel manner and are provided with a predetermined spacing to allow the blower air to flow around the cells. The blower air is thus heated by convection as it circulates over the cells.

A sheet metal panel or cell panel having burner target plates is typically provided to position the burner box relative to the cells contained in the heat exchanger. The burner target plates provided in the cell panel serve two functions in that they provide a seat for an inlet port of a corresponding heat exchanger cell while also providing a zone or target area with a central opening at which a corresponding burner is directed so that heated flue gas produced by combustion is directed into the corresponding heat exchanger cell.

The residential heating industry has advanced with the advent of condensing gas furnaces. These furnaces typically included a primary heat exchanger as well as a condensing heat exchanger. A blower in these condensing heat furnaces similarly provides circulating air flow over both heat exchangers to produce heated air that may be directed to a desired location by a system of ductwork and registers.

In such condensing furnaces, both the primary heat exchanger and the condensing heat exchanger include cells with a channel or pass formed therein to direct the flow of flue gas produced by combustion. These cells in both the primary and secondary heat exchangers are positioned side by side in a parallel manner and are provided with a predetermined spacing to allow blower air to flow around both groups of heat exchanger cells. Gas is similarly provided to the condensing furnace by a gas manifold having orifices that direct the gas into burners contained in a burner box. The gas is ignited by an ignitor as it exits the burners contained in the burner box. The heat and flue gas produced by combustion is then directed into the primary heat exchanger cells and induced to move through the heat exchangers.

The condensing heat exchanger of the furnace is configured in a similar manner to its primary heat exchanger. A series of side by side condensing cells is provided. Each of these condensing cells has an inlet port for receiving flue gas discharged from the primary heat exchanger. The inlet ports of the condensing heat exchanger cells are aligned and secured in a sheet metal panel forming the inlet side of the condensing heat exchanger. The condensing cells function to exchange heat with the clean circulation air and to condense water vapor out of the products of combustion contained in the flue gas. This condensate drains from the condensing cells into a collector box provided on the discharge side of the condensing heat exchanger. The collector box includes tubing to further drain the condensate from the box into drain piping. The two heat exchangers are mounted together to form a single integrated unit capable of receiving and heating clean circulating air provided from the blower. These condensing gas furnaces similarly include a cell panel having burner target plates for aligning the primary heat exchanger cells and directing burner discharge into the cells.

With recent advancements in the art, a commercially feasible condensing gas furnace having four possible installation orientations has been proposed by the assignee of the present invention. Such gas-fired furnaces are known in the art as multi-poise condensing furnaces and are disclosed, for example, in the copending, commonly assigned U.S. patent application Ser. No. 08/089697, entitled "Multi-Poised Condensing Furnace". These multi-poise furnaces are installable with either an upflow, downflow, horizontal-right flow, or horizontal-left flow orientation. They include design features which allow the furnace to function properly and just as efficiently in any one of these four possible installation orientations. One such feature results in proper drainage of condensate from the condensing heat exchanger cells into the collector box irrespective of the selected installation orientation.

All of the above gas-fired furnaces include combustion burners having an inlet end for receiving a supply of gas from a gas manifold and a discharge end for directing heated flue gas into a corresponding heat exchanger cell. Recent technical advances in the art have allowed for the manufacture of individual burners which require periodic inspection and replacement when necessary. It has thus become desirable to accommodate these burners in an assembly allowing ease of manufacture and quick inspection and replacement of individual burners with a minimum of disassembly of the furnace.

OBJECTS AND SUMMARY OF THE INVENTION

It is, therefore, an object of the present invention to improve gas furnaces.

It is a further object of the present invention to enable combustion burners contained in the burner box of a gas furnace to be quickly removed from the burner box while the box remains secured to the furnace.

A further object of the present invention is to securely position individual combustion burners relative to one another prior to assembly with the burner box of a gas furnace.

Still another object of the present invention is to align the discharge end of a combustion burner with the respective inlet port of a corresponding heat exchanger cell.

Yet another object of the present invention is to releasably secure individual combustion burners to a support member which, in turn, is easily secured to a bracket positioned in the burner box of a gas furnace so that the discharge end of each of the burners is aligned with a corresponding heat exchanger cell.

An additional object of the present invention is to enable a combustion burner assembly to be assembled and disassembled with a gas furnace through the front end of a burner box while the box remains secured to the furnace.

These and other objects are attained in accordance with the present invention wherein there is provided a elongated support member having a yoke section for each burner required in the furnace. The support member is further provided with an upwardly directed mounting ear positioned between yoke sections and on each end of the elongated support member. At least one supporting shelf is provided adjacent and perpendicular to each mounting ear. Finally, an upwardly directed bendable tab is provided adjacent each supporting shelf.

In accordance with one aspect of the present invention, each of the burners is provided with a flange segment formed around the periphery of the burner. The flange segment includes a pair of spaced-apart mounting apertures each of which is positioned on opposed sides of the burner. Consecutive tabs on the support member are spaced to receive the pair of mounting apertures on a respective burner so that the respective burner may be positioned within the yoke section with its peripheral flange segment supported by consecutive supporting shelves and its pair of spaced-apart mounting apertures in register with consecutive tabs. To assist in quick and proper alignment, a mounting slot is provided proximate to each mounting aperture. The slots engage consecutive mounting ears so that the burner slides down until the rests against the supporting shelves and the tabs are positioned within the apertures. In this condition, the tabs may be bent over onto the burner flange to secured the burner to the elongated support member thereby forming a rigid burner assembly.

According to another aspect of the present invention, the open discharge end of the burner box is secured to the gas furnace and is provided with a bracket for securely receiving the burner assembly. When the burner assembly is mounted to the bracket, the burners are positioned within the burner box so that each burner discharge end is aligned with a corresponding inlet port of a respective cell in the furnace heat exchanger. In this condition, each burner inlet end is positioned to receive gas supplied by a corresponding gas manifold orifice. Thus when the burners require inspection, the burner assembly is quickly removed from within the burner box through the front end thereof while the burner box remains secured to the inlet side of the heat exchanger. The number of yoke sections provided in the support member corresponds to the number of burners provided in the burner box which, in turn, corresponds to the number of heat exchanger cells provided in the primary heat exchanger. An appropriate number of burners will vary with furnace capacity and any such particular number is not considered a function of the present invention.

BRIEF DESCRIPTION OF THE DRAWING

Further objects of the present invention together with additional features contributing thereto and advantages accruing therefrom will be apparent from the following description of a preferred embodiment of the invention which is shown in the accompanying drawing with like reference numerals indicating like components throughout, wherein.

DETAILED DESCRIPTION OF A PREFERRED EMBODIMENT

Figure 1:
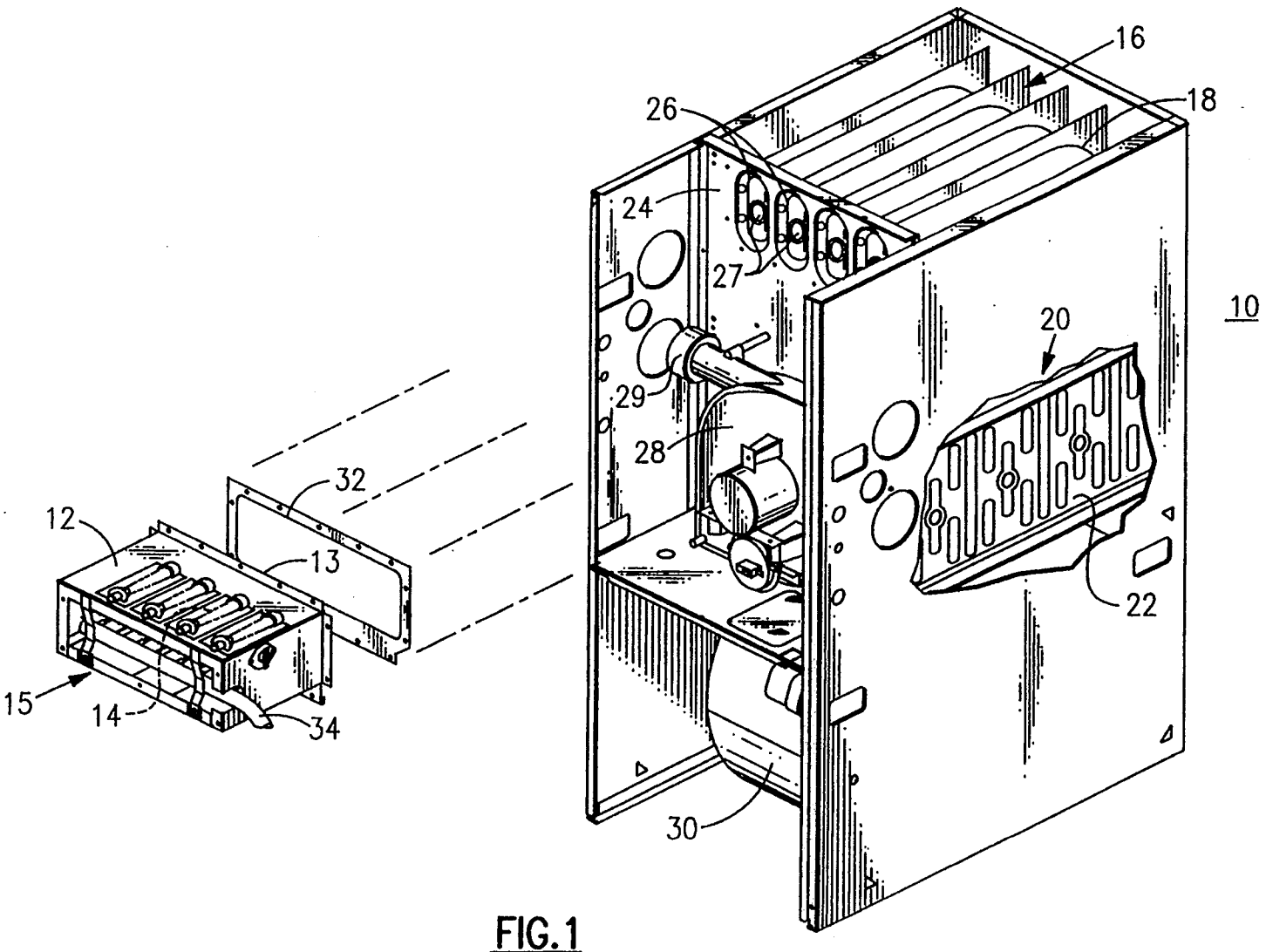
FIG. 1 is a partially exploded perspective view of a multi-poise gas furnace incorporating the burner assembly of the present invention.

Referring now to the drawing and initially to FIG. 1, there is shown a multi-poise condensing gas furnace 10 incorporating a burner box 12 and burner assembly 14 in accordance with the present invention. The box 12 and assembly 14 are shown in conjunction with a multi-poise furnace only by way of illustration and may be effectively employed in any gas furnace requiring burners. All directional references used herein are taken relative to the upflow installation orientation shown in the drawing.

The multi-poise furnace 10 includes a primary heat exchanger 16 which includes primary heat exchanger cells 18. The furnace 10 also includes a condensing heat exchanger 20 which similarly includes condensing heat exchanger cells 22. A cell panel 24 includes a number of burner target plates 26 formed on the inlet side of the primary heat exchanger 16. Each of the burner target plates 26 includes an inlet 27 corresponding to an inlet port in each primary heat exchanger cell 18 contained within the heat exchanger 16. An inducer 28 is provided on the front side of the furnace and is employed to induce the flow of heated flue gas and combustion products through the heat exchanger cells 18 and 22. The inducer 28 includes an inducer discharge port 29 which is connected to venting pipe (not shown) to vent the flue gas to an exterior location. The furnace 10 is also provided with a blower 30 for moving circulating air over the heat exchanger cells 18 and 22 so that the circulating air may be heated by convection. The burner box 12 is mounted to the inlet side of the primary heat exchanger 16 with a burner box gasket 32 positioned therebetween to provide a tight seal between the box 12 and the cell panel 24. The burner assembly 14 is provided gas through a gas manifold 34.

Figure 2:
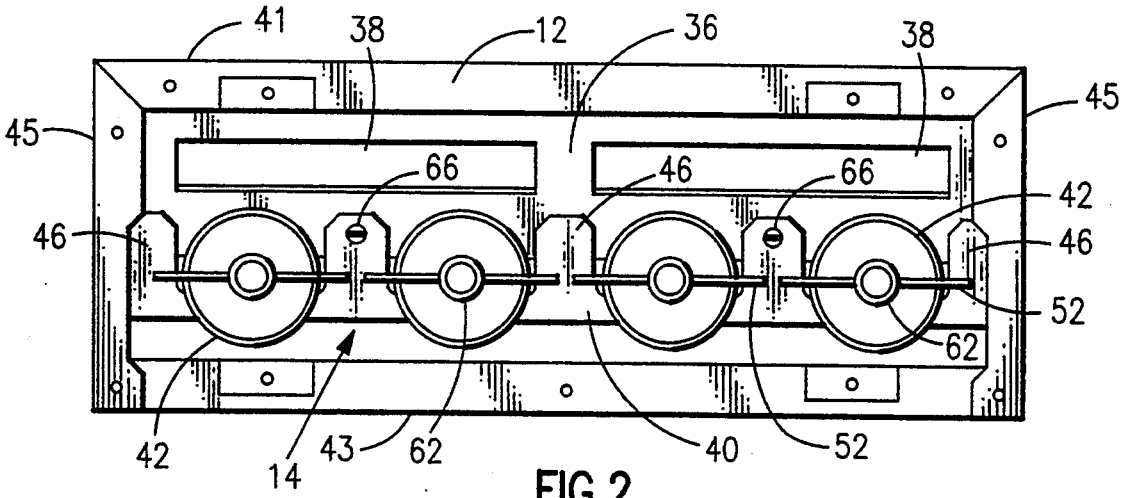
FIG. 2 is a front elevational view of the burner box of FIG. 1 showing the burner assembly of the present invention.
Figure 4:
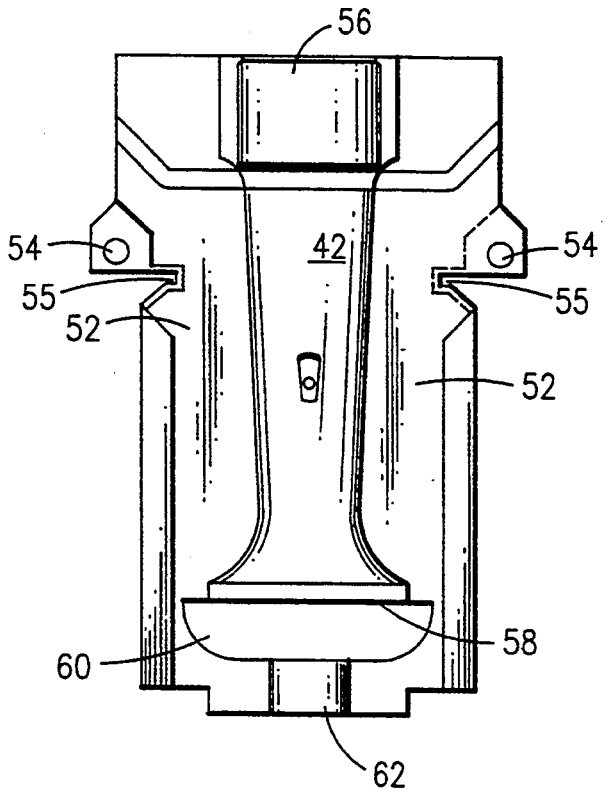
FIG. 4 in a plan view of an individual burner according to the present invention.
Figure 3:
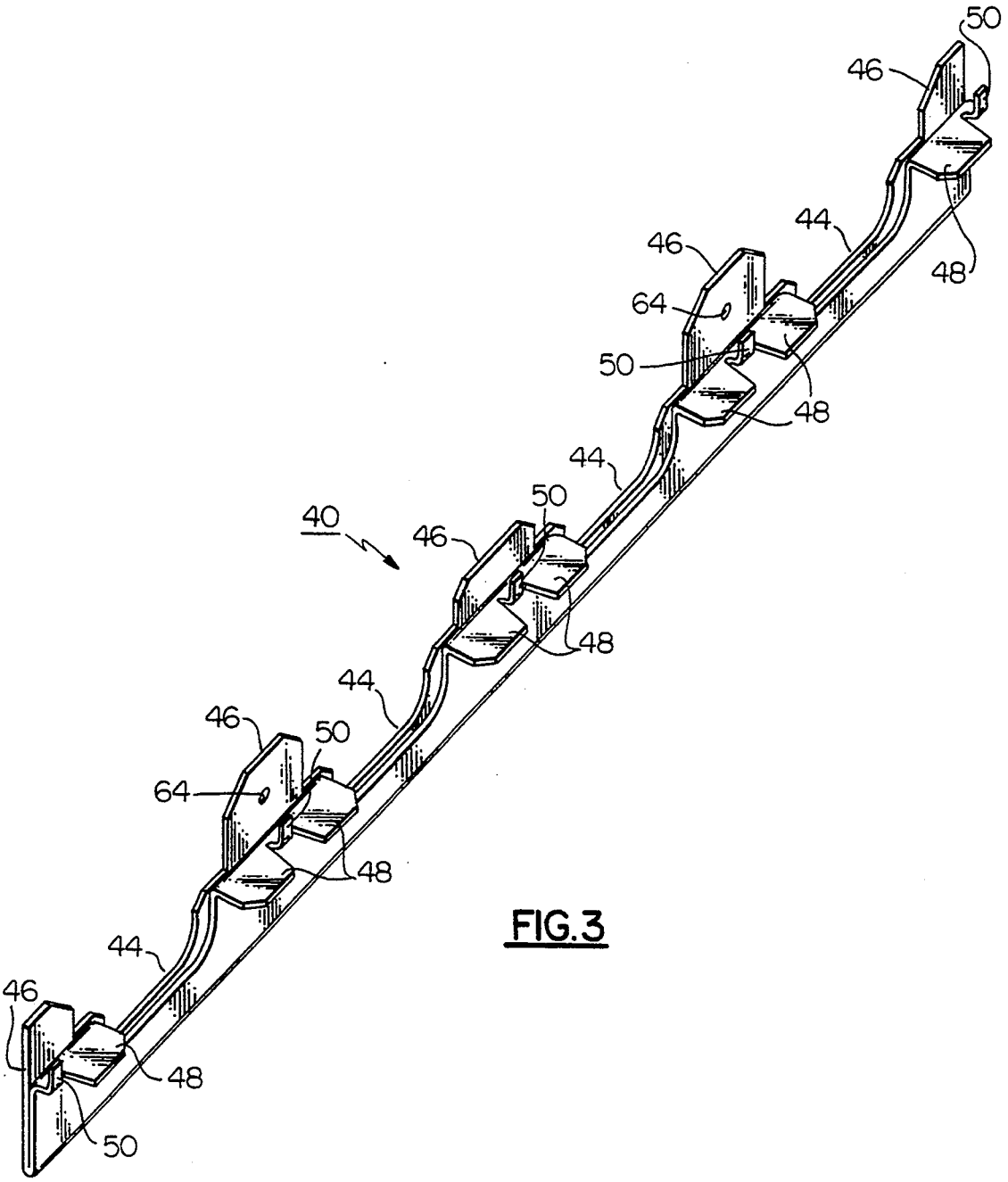
FIG. 3 is a perspective view of the elongated support member in accordance with the present invention.

With reference to FIG. 2, it is shown that the burner box 12 includes a top wall 41, a bottom wall 43, and opposing side walls 45. The burner box is provided with a rectangular bracket or sheet member 36, which depends downwardly from the top wall 41 and extends from side to side between the opposing side walls 45 of the burner box 12. The rectangular bracket 36 includes a pair of elongated rectangular air inlets 38 which allow secondary combustion air into the discharge end 13 of the box 12 to provide sufficient air for combustion. The burner assembly 14 includes an elongated support member 40 and individual burners 42. As shown in both FIGS. 2 and 3, support member 40 includes a yoke section 44 for each of the burners 42 and mounting ears 46 positioned on either side of the yoke sections 44 and on the ends of the support member 40. A support shelf 48 is positioned perpendicular to each of the mounting ears 46 as shown in FIG. 3. Each of the interior mounting ears 46 include two supporting shelves 48 while the mounting ears on either end of the support member 40 require only one supporting shelf 48. Adjacent each supporting shelf 48 is an upwardly directed bendable tab 50, as shown in FIG. 3. Referring now to FIGS. 2 and 4, it is shown that each of the burners 42 include a flange segment 52 formed around the periphery of the burner. The flange segment 52 includes a pair of mounting apertures 54 which are positioned on either side of the burner 42. The flange 52 is also provided with a pair of mounting slots 55, each of the slots 55 being positioned adjacent a mounting aperture 54 as shown in FIG. 4. The burners 42 each include a discharge end 56 and an inlet end 58. The flange 52 includes an opening 60 positioned immediately adjacent the inlet end 58 of the burner 42. As shown in FIGS. 2 and 4, a portion of the flange segment proximate to the inlet end 58 includes an annular manifold adaptor 62. The flange segment 54 is composed of two parallel sheets of metal in contact with each other within the flange segment 52. The two sheets forming the flange segment are then shaped into half-round tube sections to form corresponding halves of the burner 42. In a similar manner, half-round ring sections formed in the two sheets proximate the inlet end of each burner form corresponding halves of the annular manifold adapter 62.

Figure 6:
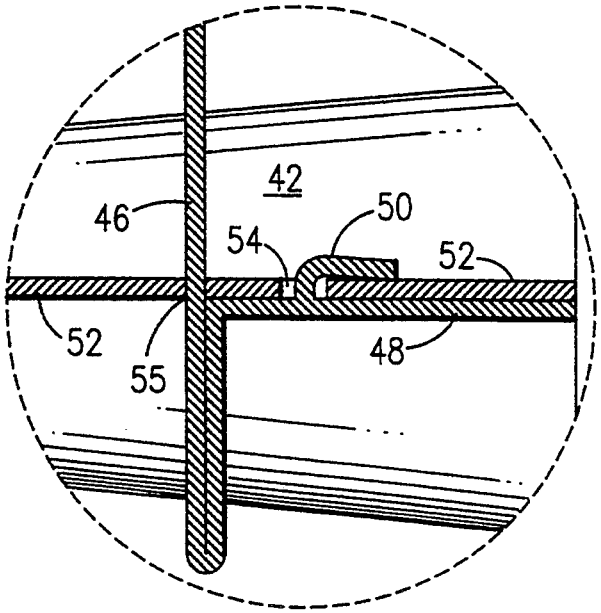
FIG. 6 is an enlarged detailed view of the area 6—6 identified in FIG. 5.

To assemble an individual burner 42 with the support member 40, the burner 42 is placed so that the bottom portion of the burner is positioned above a corresponding yoke section 44. As the burner 42 is moved down toward the yoke section, consecutive mounting ears 46 will slide into the opposed mounting slots 55. As the mounting slots slide down consecutive supporting ears, consecutive tabs 50 will be in register with the mounting apertures 54. When the burner comes to rest snugly within the yoke 44, the flange segment 52 of the burner will rest upon consecutive support shelves 48 with a pair of consecutive bendable tabs positioned through the apertures 54. At this point, the bendable tabs 50 may be bent over as shown in FIG. 6 to secure the burner 42 to the elongated support member 40.

The particular support member 40 shown in the drawing is designed to accommodate four individual burners 42. A burner 42 is placed in each of the four yoke sections 44 one after the other, as described above. As shown in FIG. 4, the immediate area surrounding a mounting aperture 54 is formed from only one sheet of the two sheet members forming the flange 52. One of a pair of apertures 54 is formed by the bottom sheet while the other is formed from the top sheet. In this manner, when the burners 42 are placed one after the other in the yoke sections, the areas surrounding coincident apertures 54 will overlap with each another to create the double thickness corresponding to the rest of the flange segment 52. In this condition, the tabs 50 may be bent over to secure adjacent burners 42 to the support member 40, thus completing the burner assembly 14 in accordance with the present invention.

Figure 5:
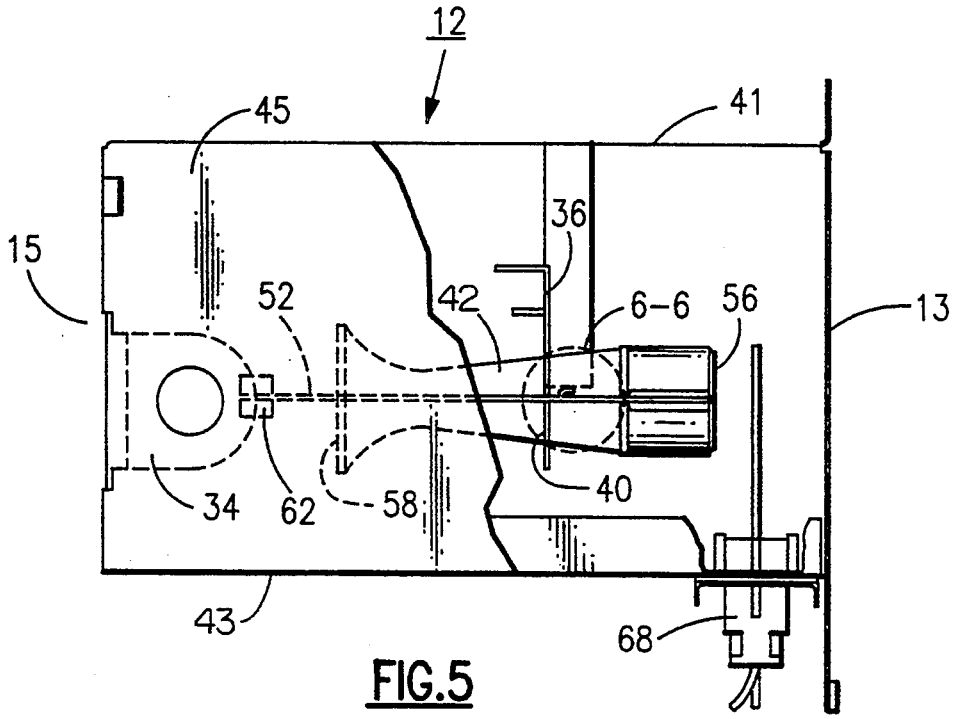
FIG. 5 is a partially broken-away side elevational view of the furnace burner box showing the burner assembly of the present invention.

With reference now to FIGS. 2 and 3, it is shown that two of the mounting ears 46 include a screw hole 64. Once the burner assembly 14 is complete, the assembly may be mounted within the burner box 12 by sheet metal screws 66 as shown in FIG. 2. The discharge end of the burner box 13 is secured to the cell panel 24, as mentioned above. The burner assembly 14 may be mounted within the burner box 12 from the front end 15 thereof, without the burner box 12 having to be disassembled from the cell panel. Once the burner assembly is mounted to the burner box 12, as shown in FIG. 2, the gas manifold 34 may then be installed thereover. As shown in FIG. 5, each of the annular manifold adaptors 62 engage the gas manifold 34 so that a supply of gas will be directed past the opening 60 and into the inlet end 58 of the burner 42. As the gas moves through the burner 42, an ignitor 68 will ignite the gas in the vicinity of the discharge end 56 of the burner. As shown in FIG. 1, when the burner box is mounted to the cell panel 24, each discharge end 56 of a corresponding burner 42 will be aligned to direct heated flue gas and combustion products directly into a corresponding inlet port 27.

During the life of the furnace, it is necessary to periodically inspect the furnace for routine maintenance. In accordance with one aspect of the present invention, a service person inspecting the furnace 10, after removing the gas manifold 34, is able to quickly remove the burner assembly 14 through the front end 15 of the burner box 12 by simply unscrewing the two sheet metal screws 66 while the burner box remains secured to the cell panel 24. Once the burner assembly 14 is removed from the burner box, individual burners 42 may be inspected and, if necessary, easily replaced by simply prying up consecutive tabs 50, removing the individual burner and replacing that burner with a new burner. The new burner is then readily secured to the elongated member by the tabs 50.

While this invention has been described in detail with reference to a certain preferred embodiment, it should be appreciated that the present invention is not limited to that precise embodiment. Rather, in view of the present disclosure, many modifications and variations would present themselves to those of skill in the art without departing from the scope and spirit of this invention, as defined in the following claims.

What is claimed is:

1. In a furnace of the type having combustion burners each with an inlet end and a discharge end, the burners for receiving a gas from a manifold orifice and for directing resultant heat into inlet ports of a heat exchanger, the improvement comprising in combination:

a burner box for receiving and positioning the burners and a gas manifold therein, said burner box having an accessible front end and an open discharge end being securable to the inlet side of the heat exchanger to cover the inlet ports;

support means for securely receiving and positioning each of the burners in a predetermined location relative to one another so that the burners are aligned in said support means to form a rigid unitary burner assembly; and bracket means mounted within said burner box for securely receiving the burner assembly and for positioning the burners within said burner box so that when the burner box is secured to the inlet side of the heat exchanger, each burner is aligned with one of the inlet ports and positioned to receive a corresponding gas manifold orifice whereby when the burners require inspection, the burner assembly is quickly removed from within the burner box through the front end thereof while the burner box remains secured to the inlet side of the heat exchanger.

2. The improved furnace according to claim 1 wherein said burner box is rectangular in cross section between the front and discharge ends thereof and includes a top wall, a bottom wall, and opposing side walls and said bracket means includes a generally rectangular sheet member having opposing top and bottom edges and opposing side edges, said rectangular sheet member depending downwardly from the top wall of the burner box in a predetermined cross sectional plane, the top edge being positioned adjacent the top wall and the bottom edge being positioned above the bottom wall so that the burner assembly is positionable under the bottom edge, the sheet member extending between the opposing side walls of the burner box from one of the side edges to the other.

3. The improved furnace according to claim 1, wherein a flange segment is formed around an exterior periphery of each of the burners and includes a pair of spaced mounting apertures and a mounting slot adjacent each aperture, and further wherein said support means includes a generally elongated member having a yoke section for each burner, an upwardly directed mounting ear positioned between yoke sections, at least one supporting shelf adjacent each mounting ear and being perpendicular thereto, and an upwardly directed bendable tab adjacent each supporting shelf and being positioned to receive a respective mounting aperture thereover so that a respective burner may be positioned with respect to the elongated member by engaging consecutive ears with its mounting slots, and then positioned within said yoke section with its peripheral flange segment supported by consecutive supporting shelves and its pair of spaced-apart mounting apertures in registry with consecutive tabs, whereby when the tabs are bent over, the burner is secured to said elongated member.

4. The improved furnace according to claim 2 wherein said rectangular sheet member includes at least one air inlet positioned proximate said top edge thereof.

5. The improved furnace according to claim 2 wherein said rectangular sheet member includes two elongated rectangular air inlets positioned proximate said top edge thereof.

6. The improved furnace according to claim 2 wherein said rectangular sheet member includes two screw holes being spaced along a line proximate said bottom edge thereof and two of said mounting ears each include a screw hole corresponding to one of the holes in the sheet member so that the burner assembly is securable to the sheet member by sheet metal screws.

7. A burner assembly for aligning combustion burners in a burner box of a gas-fired furnace, each of the burners having an inlet end for receiving a supply of gas and a discharge end for directing the resulting heated flue gas into a corresponding inlet port of a respective heat exchanger cell, the burner box having an accessible front end and an open discharge end being secured to an inlet side of a heat exchanger to cover the inlet ports, said assembly comprising:

a flange segment formed around an exterior periphery of each of the burners, said flange segment including a pair of spaced-apart mounting apertures and a mounting slot adjacent each aperture;

support means for receiving and securing said flange segments such that each of the burners thereon is disposed in a predetermined location relative to one another, said support means including a generally elongated member having a yoke section for each burner, an upwardly directed mounting ear positioned between yoke sections, at least one supporting shelf adjacent each mounting ear and being perpendicular thereto, and an upwardly directed bendable tab adjacent each supporting shelf and being positioned to receive a respective mounting aperture so thereover that a respective burner may be positioned with respect to the elongated member by engaging consecutive ears with its mounting slots, and then positioned within said yoke section with its peripheral flange segment supported by consecutive supporting shelves and its pair of spaced-apart mounting apertures in registry with consecutive tabs, whereby when the tabs are bent over the burner is secured to said elongated member;

wherein the burner assembly is securable through the front end of the burner box to bracket means positioned therein so that each discharge end of a respective burner is thereby aligned with the corresponding inlet port of the respective heat exchanger cell.

8. The burner assembly according to claim 7 wherein the burner box is rectangular in cross section between the front and discharge ends thereof and includes a top wall, a bottom wall, and opposing side walls and the bracket means includes a generally rectangular sheet member having opposing top and bottom edges and opposing side edges, the rectangular sheet member depending downwardly from the top wall of the burner box in a predetermined cross sectional plane, the top edge adjacent the top wall and the bottom edge being positioned above the bottom wall and including two screw holes being spaced along a line proximate the bottom edge and wherein two of said mounting ears of said elongated member each include a screw hole corresponding to one of the holes in the sheet member so that the burner assembly is securable to the sheet member by sheet metal screws whereby when the burners require inspection, the burner assembly is quickly removed from within the burner box through the front end thereof while the burner box remains secured to the inlet side of the heat exchanger.

9. An elongated support member for aligning combustion burners in the burner box of a gas-fired furnace, each of the burners having an inlet end for receiving a supply of gas and a discharge end for directing the resulting heated flue gas into a corresponding inlet port of a respective heat exchanger cell, the burner box having an accessible front end and an open discharge end being secured to an inlet side of a heat exchanger containing the cells to cover the inlet ports thereof, each of the burners further having a flange segment formed around an exterior periphery thereof, the flange segment including a pair of spaced-apart mounting apertures and a mounting slot adjacent each aperture, said elongated support member comprising, a yoke section for each burner, an upwardly directed mounting ear positioned between yoke sections at least one supporting shelf adjacent each mounting ear and being perpendicular thereto, and an upwardly directed bendable tab adjacent each supporting shelf and being positioned to receive a respective mounting aperture thereover so that a respective burner may be positioned with respect to the support member by engaging consecutive ears with its mounting slots, and then positioned within said yoke section with its peripheral flange segment supported by consecutive supporting shelves and its pair of spaced-apart mounting apertures in registry with consecutive tabs, whereby when the tabs are bent over, the burner is secured to said elongated support member.

10. The elongated support member according to claim 9 wherein the burner box includes a bracket member having two screw holes and two of said mounting ears of the elongated member each include a screw hole corresponding to one of the holes in the bracket member so that the burner assembly is securable to the bracket member by sheet metal screws so that the discharge ends of each of the burners is aligned with the corresponding inlet port of the respective heat exchanger cell whereby when the burners require inspection, the burner assembly is quickly removed from within the burner box through the front end thereof while the burner box remains secured to the inlet side of the heat exchanger.

* * * * *